US008657471B2

(12) United States Patent
Huang et al.

(10) Patent No.: US 8,657,471 B2
(45) **Date of Patent: *Feb. 25, 2014**

(54) LED LAMP

(75) Inventors: Wei-Jen Huang, New Taipei (TW); Jui-Wen Hung, New Taipei (TW); Ching-Bai Hwang, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 287 days.

This patent is subject to a terminal disclaimer.

(21) Appl. No.: 13/169,039

(22) Filed: Jun. 27, 2011

(65) Prior Publication Data

US 2012/0250334 A1 Oct. 4, 2012

(51) Int. Cl.
*F21V 29/00* (2006.01)

(52) U.S. Cl.
USPC ..... 362/294; 362/373; 362/800

(58) Field of Classification Search
USPC ..... 362/294, 373, 547, 545, 218, 264
See application file for complete search history.

(56) References Cited

U.S. PATENT DOCUMENTS

2009/0040760 A1* 2/2009 Chen et al. ..... 362/249
2012/0236567 A1* 9/2012 Hung et al. ..... 362/294

* cited by examiner

*Primary Examiner* — Jong-Suk (James) Lee
*Assistant Examiner* — Leah S Macchiarolo
(74) *Attorney, Agent, or Firm* — Altis Law Group, Inc.

(57) ABSTRACT

An LED lamp includes a heat sink, a heat pipe and an LED. The heat sink includes a connecting core and fins mounted around the connecting core. Each of the fins includes a plate-shaped main body and a flange extending perpendicularly from a periphery side of the main body. The flanges of the fins cooperatively form an annular planar top surface of the heat sink. The heat pipe includes a condensing section, an evaporating section parallel to and higher than the condensing section and an adiabatic section connected between the condensing section and the evaporating section. The condensing section is fixed to and thermally connects with the top surface of the heat sink. The LED is directly mounted on the evaporating section with a light emitting surface thereof facing outwardly.

12 Claims, 6 Drawing Sheets

LED LAMP

BACKGROUND

1. Technical Field

The disclosure relates to illumination devices, and particularly to an LED lamp.

2. Description of the Related Art

Light emitting diodes (LEDs) have many advantages, such as high luminosity, low operational voltage, low power consumption, compatibility with integrated circuits, easy driving, long term reliability, and environmental friendliness. Such advantages have promoted the wide use of LEDs as a light source. Now, LEDs are commonly applied in lighting.

However, for a high-power LED lamp, heat accumulation can affect the life, stability and reliability of the lamp. Thus, how to effectively dissipate the heat of the LED lamp has become a challenge for engineers to design the LED lamp.

Therefore, it is desirable to provide an LED lamp which has good heat dissipation capabilities.

DETAILED DESCRIPTION

An embodiment of an LED lamp as disclosed is described in detail here with reference to the drawings.

Figure 1:
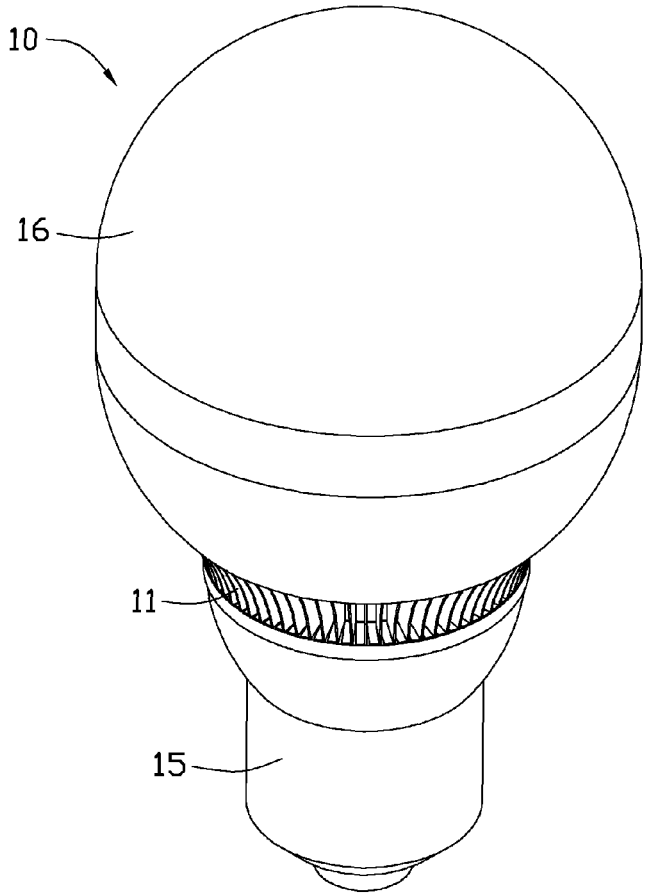
FIG. 1 is a schematic, assembled view of an LED lamp in accordance with an exemplary embodiment, wherein the LED lamp includes a heat sink, a heat pipe, an LED, a lamp header and a lamp cover.
Figure 2:
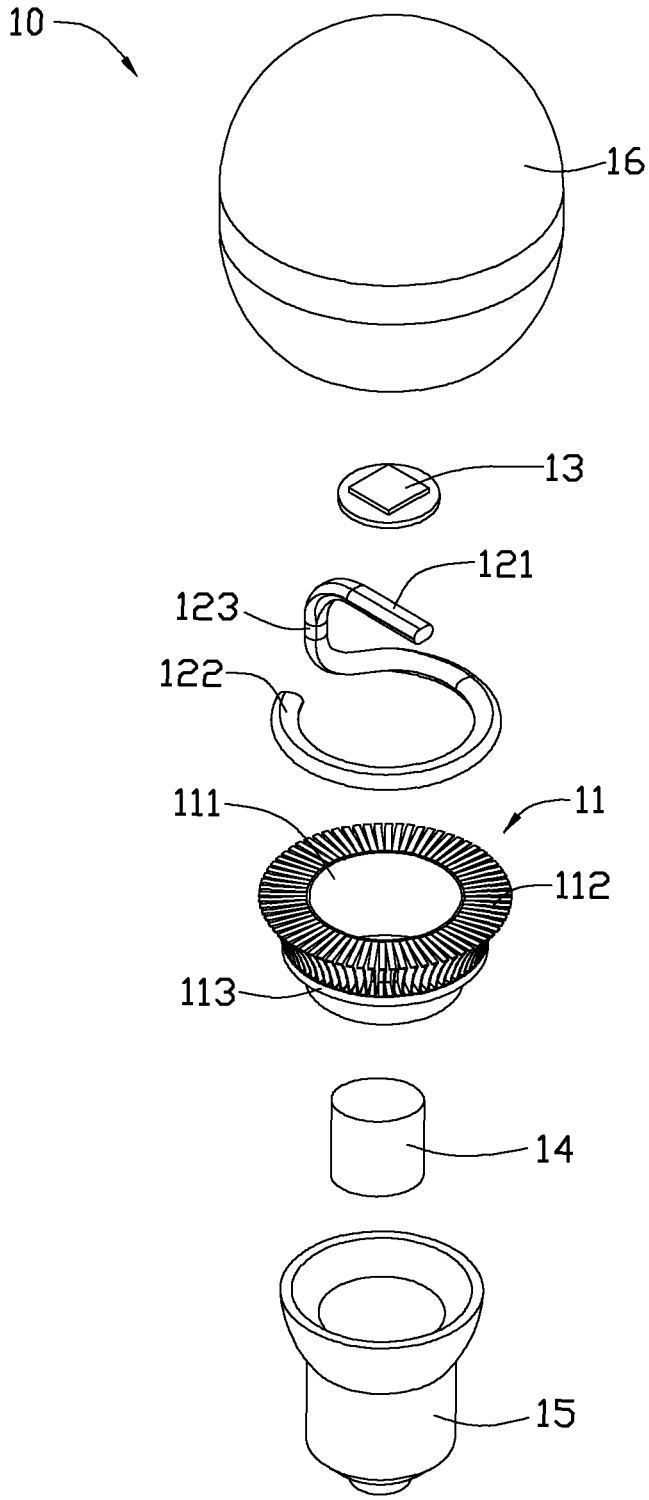
FIG. 2 is an exploded view of the LED lamp of FIG. 1.
Figure 3:
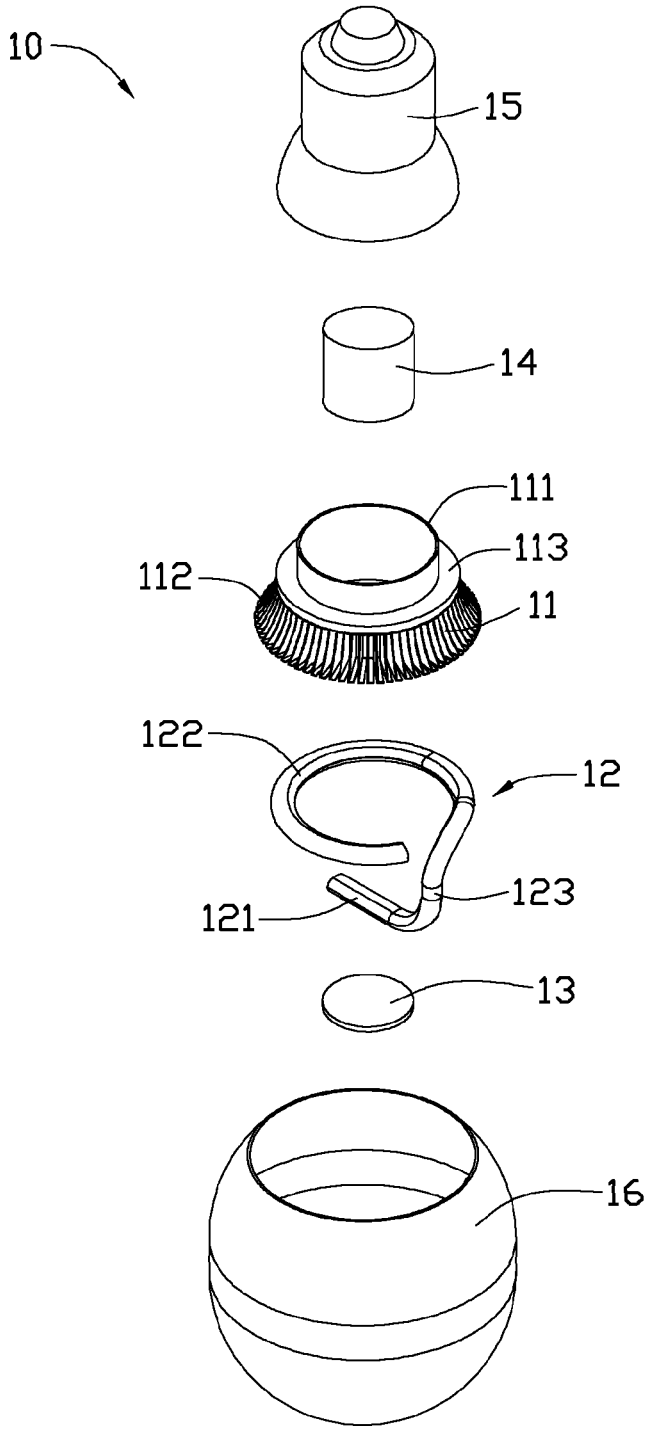
FIG. 3 is a view similar to FIG. 2, but shown from a different aspect.

Referring to FIGS. 1-3, an LED lamp 10 in accordance with the disclosure includes a heat sink 11, a heat pipe 12, an LED 13, a drive circuit 14, a lamp header 15 and a lamp cover 16. The LED lamp 10 specifically is an LED bulb.

Figure 4:
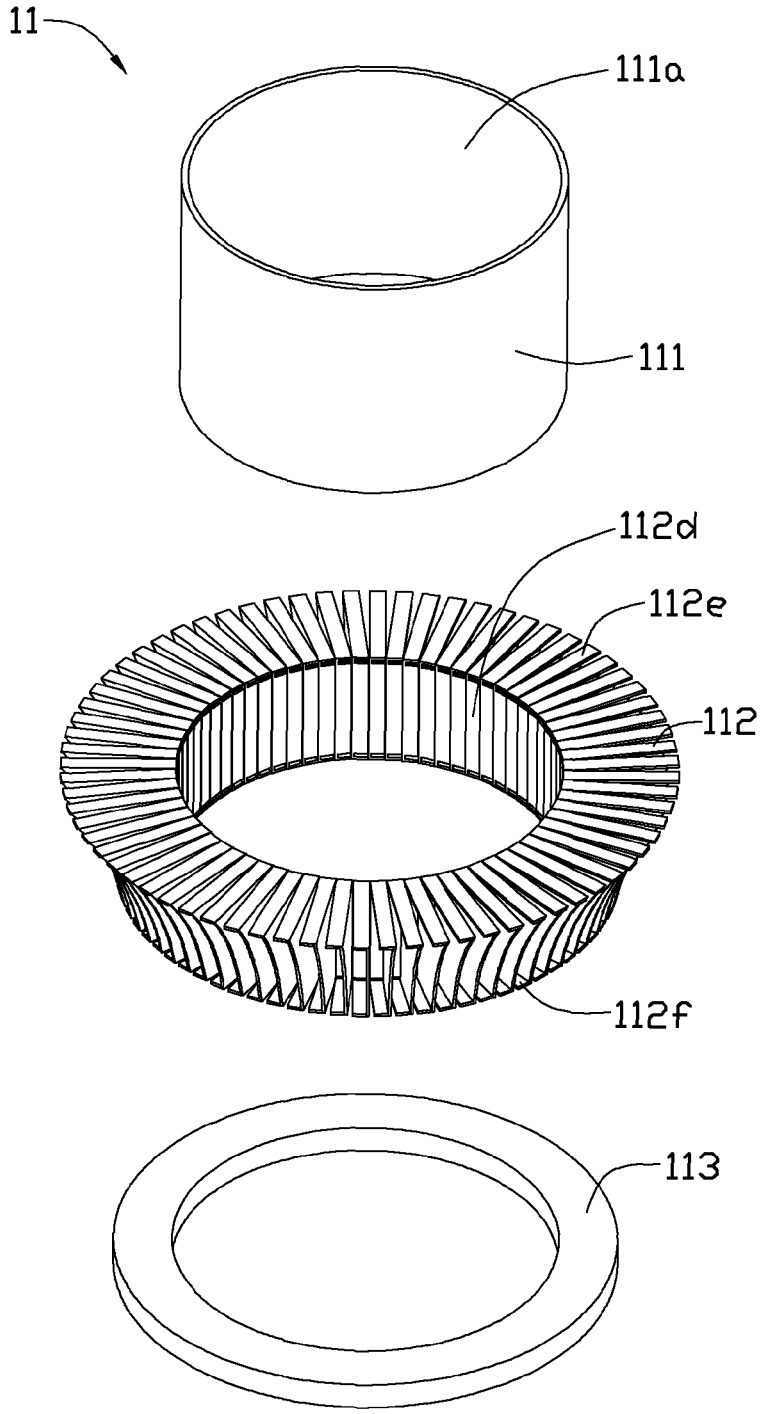
FIG. 4 is an enlarged view of the heat sink of the LED lamp of FIG. 2, wherein the heat sink includes a connecting core, a plurality of fins and a supporting ring.
Figure 5:
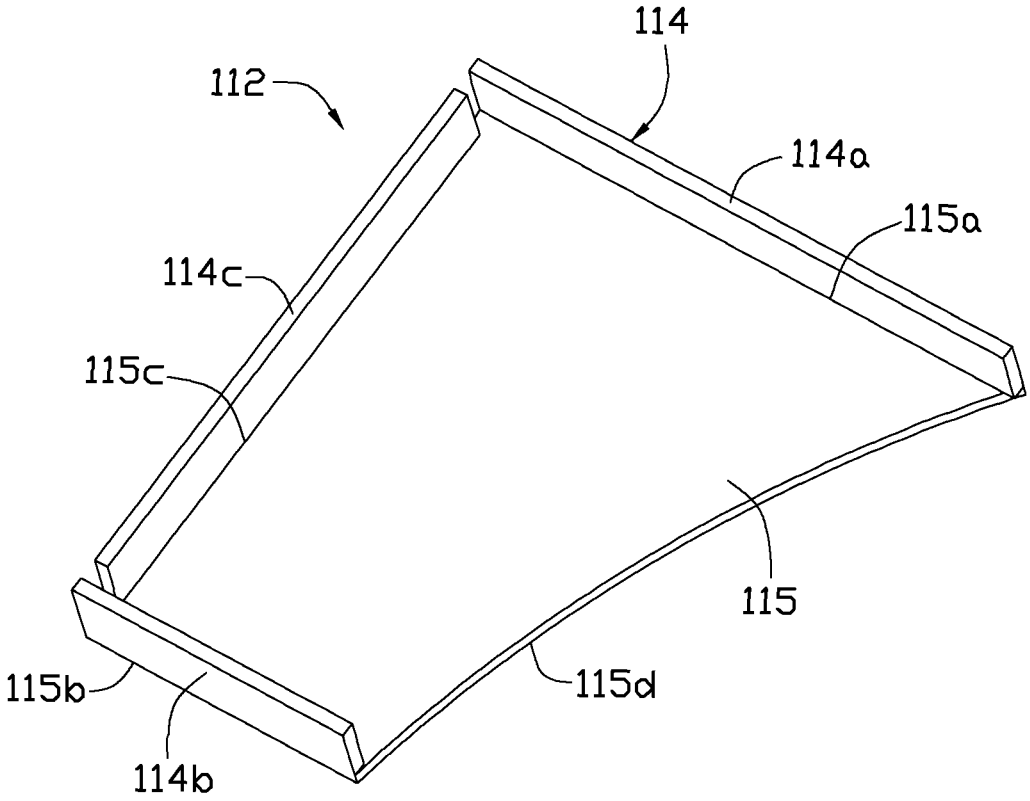
FIG. 5 is an enlarged view of one of the fins of the heat sink of FIG. 4.
Figure 6:
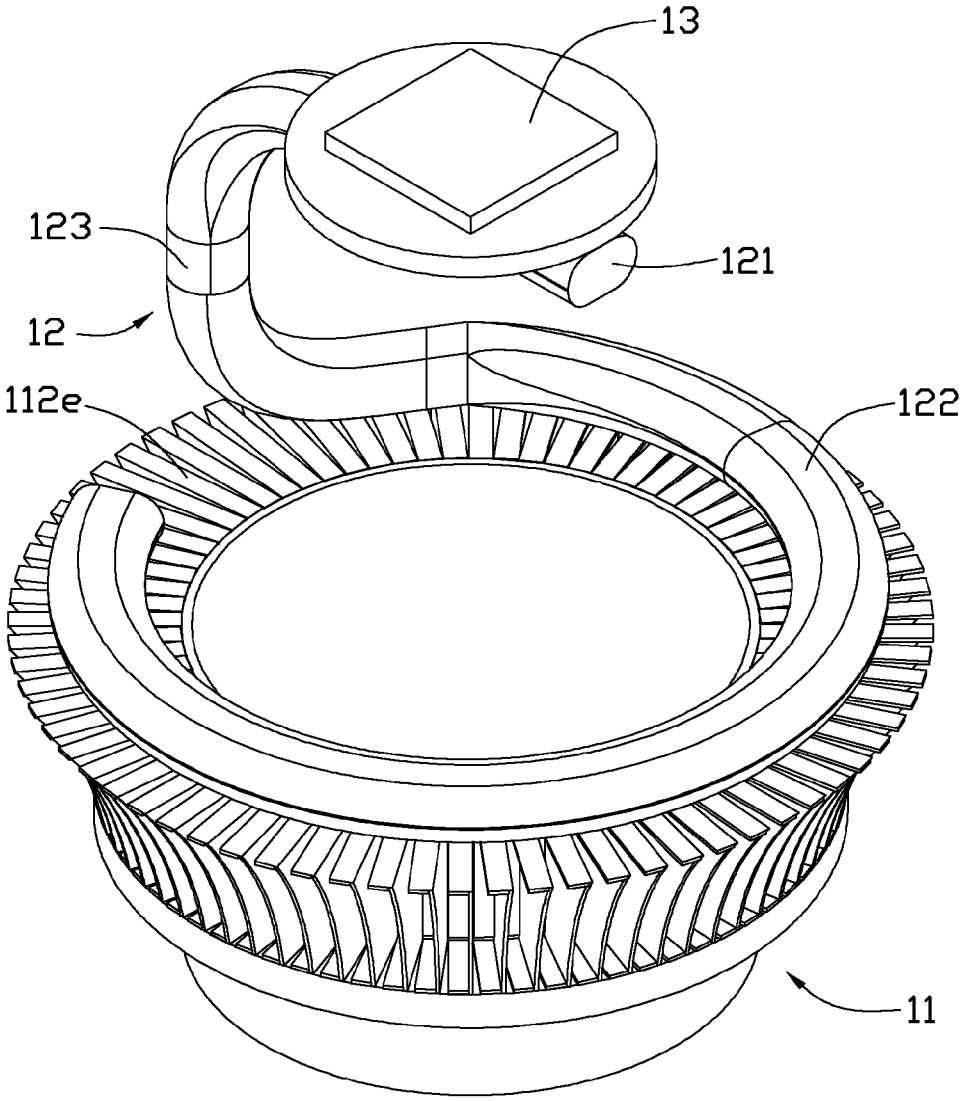
FIG. 6 is an assembled view of the LED lamp of FIG. 1 with the lamp header and the lamp cover omitted for purposes of illustration.

Referring also to FIGS. 4 and 5, the heat sink 11 includes a hollow, cylindrical connecting core 111, a plurality of fins 112 arranged around the connecting core 111 and a supporting ring 113. The connecting core 111 defines a receiving space 111*a* at a central portion along an axial direction thereof. Each of the fins 112 includes a plate-shaped main body 115 and a flange 114 extending perpendicularly from a peripheral side of the main body 115.

An outline of the main body 115 includes a straight upper side 115*a*, a straight lower side 115*b* shorter than the upper side 115*a*, a straight outer side 115*c* connected between corresponding outer ends of the upper and lower sides 115*a*, 115*b*, and an arced inner side 115*d* connected between the corresponding inner ends of the upper and lower sides 115*a*, 115*b*. The flange 114 includes a first portion 114*a* extending from the upper side 115*a* of the main body 115, a second portion 114*b* extending from the lower side 115*b* of the main body 115, and a third portion 114*c* extending from the straight outer side 115*c* of the main body 115. When the heat sink 11 is assembled, the first portions 114*a* of the flanges 114 connected to each other to cooperatively form an annular planar top surface 112*e* of the heat sink 11, the second portions 114*b* of the flanges 114 connected to each other to cooperatively form an annular planar bottom surface 112*f* of the heat sink 11, and the third portions 114*c* of the flanges 114 connected to each other to cooperatively form a cylindrical inner surface 112*d* abutting against an outer surface of the connecting core 111.

The fin 112 is shorter than the connecting core 111. The top surface 112*e* of the heat sink 11 is coplanar with a top end of the connecting core 111, and the bottom surface 112*f* of the heat sink 11 is higher than a bottom end of the connecting core 111. The supporting ring 113 has an inner diameter substantially equal to or slightly smaller than an outer diameter of the connecting core 111. The supporting ring 113 is mounted around the connecting core 111 with a top side thereof in contact with the bottom surface 112*f* of the heat sink 11.

The heat pipe 12 is mounted at the top surface 112*e* of the heat sink 11. The heat pipe 12 includes an evaporating section 121, a condensing section 122 and an adiabatic section 123 connected between the evaporating section 121 and the condensing section 122. The condensing section 122 is C-shaped. The condensing section 122 is located at an imaginary circle which has a diameter smaller than an outer diameter of a circular ring formed by the top surface 112*e* of the heat sink 11 but larger than an inner diameter of the circular ring formed by the top surface 112*e* of the heat sink 11. In other words, the diameter of the imaginary circle on which the condensing section 122 is located is substantially the same as a diameter of a circle formed by the top surface 112*e* of the heat sink 11. The adiabatic section 123 extends upward and perpendicularly from one end of the condensing section 122. The evaporating section 121 extends inward and perpendicularly from a top end of the adiabatic section 123. The evaporating section 121 is parallel to and higher than the condensing section 122, with a distal end aligned with a center of the circle formed by the top surface 112*e* of the heat sink 11. The heat pipe 12 is flat. The condensing section 122 tightly contacts the top surface 112*e* of the heat sink 11, and thermally connects with the heat sink 11 by soldering.

The LED 13 is arranged at the distal end of the evaporating section 121 of the heat pipe 12, with a light emitting surface facing upward. The LED 13 mechanically and thermally connects with the evaporating section 122 by soldering. The LED 13 is located at a central axis of the connecting core 111.

The drive circuit 14 is received in the receiving space 111*a* of the connecting core 111. The driving circuit 14 is electrically connected between the LED 13 and an outer power source (not shown), to thus supply an electric power to the LED 13 for controlling the LED 13 emit light.

The lamp header 15 connects the bottom end of the connecting core 111, and abuts a bottom side of the supporting ring 113. The lamp header 15 can be chosen from the types including E12, E14, E26, E27, GU10, PAR30 and MR16. The lamp header 15 is configured to connect with a lamp holder (not shown) by screwing, clipping or other means known in the art.

The lamp cover 17 is covered on the heat sink 11. The lamp cover 17 is configured to protect the LED 14 from dust and dirt.

Due to the LED 13 directly contacting the evaporating section 121 of the heat pipe 12, heat generated by the LED 13 can be quickly absorbed by the evaporating section 121 and then evenly transfer to the fins 112 of the heat sink 11 along an extension the condensing sections 122. Thus, the heat generated by the LED 13 can be dissipated to outer environment via the heat sink 11 effectively.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. An LED lamp, comprising:

a heat sink comprising a connecting core and a plurality of fins around the connecting core, each of the fins comprising a plate-shaped main body and a flange extending perpendicularly from a periphery side of the main body, the flanges of the fins cooperatively forming an annular planar top surface of the heat sink;

a heat pipe comprising a condensing section, an evaporating section parallel to and higher than the condensing section and an adiabatic section connected between the condensing section and the evaporating section, the condensing section being attached to and thermally connecting with the top surface of the heat sink;

an LED directly mounted on the evaporating section with a light emitting surface thereof facing outwardly.

2. The LED lamp of claim 1, wherein the condensing section is located at an imaginary circle which has a diameter substantially equal to that of a circle formed by the top surface of the heat sink.

3. The LED lamp of claim 2, wherein the LED is mounted at a position of the evaporating section which is aligned with a center of the imaginary circle.

4. The LED lamp of claim 2, wherein the condensing section is C-shaped.

5. The LED lamp of claim 4, wherein the adiabatic section extends upward and perpendicularly from one end of the condensing section, the evaporating section extending inward and perpendicularly from a top end of the adiabatic section to be located adjacent to a center of the imaginary circle.

6. The LED lamp of claim 1, wherein the connecting core is hollow, cylindrical shaped, and the LED is coaxial with a central axis of the connecting core.

7. The LED lamp of claim 6, wherein the connecting core defines a receiving space at a central portion thereof for receiving a drive circuit therein.

8. The LED lamp of claim 1, wherein an outline of the main body comprises a straight upper side, a straight lower side shorter than the upper side, a straight outer side connected between outer ends of the upper and lower sides, and an arced inner side connected between inner ends of the upper and lower sides, the flange comprising a first portion extending from the upper side of the main body, a second portion extending from the lower side of the main body and a third portion extending from the straight outer side of the main body, the first portions of the flanges cooperatively forming the top surface of the heat sink.

9. The LED lamp of claim 8, wherein the third portions of the flanges cooperatively form a cylindrical inner surface for abutting against an outer surface of the connecting core.

10. The LED lamp of claim 1, further comprising a lamp header connected a bottom end of the connecting core, the lamp header being configured to connect a lamp holder, to thus electrically connect the LED to an outer power source.

11. The LED lamp of claim 1, wherein the heat sink further comprises a supporting ring mounted around the connecting core, the supporting ring supporting the fins thereon.

12. The LED lamp of claim 1, further comprising a lamp cover covered on the heat sink for protecting the LED from dust and dirt.

* * * * *